US007488159B2

(12) United States Patent
Bhatt et al.

(10) Patent No.: US 7,488,159 B2
(45) Date of Patent: Feb. 10, 2009

(54) ZERO-CLEARANCE ULTRA-HIGH-PRESSURE GAS COMPRESSOR

(75) Inventors: Bharat Lajjaram Bhatt, Fogelsville, PA (US); William Curtis Kottke, Fogelsville, PA (US); David Jonathan Chalk, Slatington, PA (US); Todd Eric Carlson, Upper Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 701 days.

(21) Appl. No.: 10/876,794

(22) Filed: Jun. 25, 2004

(65) Prior Publication Data

US 2005/0284155 A1 Dec. 29, 2005

(51) Int. Cl.
*F04B 23/14* (2006.01)
*F04B 9/08* (2006.01)
*F04F 11/00* (2006.01)

(52) U.S. Cl. ..... 417/92; 417/85; 417/199.1; 417/385

(58) Field of Classification Search ..... 417/92, 417/99, 103, 383, 385, 390, 394, 395, 93, 417/96, 98, 87, 199.1, 225
See application file for complete search history.

(56) References Cited

U.S. PATENT DOCUMENTS

| | | | | |
|---|---|---|---|---|
| 462,776 | A | | 11/1891 | Richards |
| 586,100 | A | | 7/1897 | Knight |
| 609,088 | A | | 8/1898 | Dutton |
| 1,037,586 | A | | 9/1912 | Birawer |
| 2,564,548 | A | | 8/1951 | Sjoberg |
| 2,626,740 | A | | 1/1953 | Levy |
| 3,306,216 | A | * | 2/1967 | Warman ..... 417/92 |
| 3,749,522 | A | * | 7/1973 | Kazama et al. ..... 417/92 |
| 4,515,516 | A | | 5/1985 | Perrine et al. |
| 4,627,419 | A | * | 12/1986 | Hills ..... 417/92 |
| 5,073,090 | A | | 12/1991 | Cassidy |
| 5,092,744 | A | | 3/1992 | Boers et al. |
| 5,259,195 | A | | 11/1993 | Pringle |
| 5,984,642 | A | | 11/1999 | Danielsson |
| 6,296,690 | B1 | | 10/2001 | Charron |
| RE37,603 | E | | 3/2002 | Coney |
| 6,558,134 | B2 | | 5/2003 | Serafin et al. |
| 6,619,930 | B2 | * | 9/2003 | Jansen et al. ..... 417/390 |
| 6,652,243 | B2 | | 11/2003 | Krasnov |
| 2002/0150479 | A1 | | 10/2002 | Jansen et al. |

FOREIGN PATENT DOCUMENTS

JP 52-43105 A * 4/1977

* cited by examiner

*Primary Examiner*—Charles G Freay
(74) *Attorney, Agent, or Firm*—Joseph D. Rossi

(57) ABSTRACT

Gas compression system comprising a compression cylinder having a gas inlet, a compressed gas outlet, and one or more liquid transfer ports; a pump having a suction and a discharge; and a compressor liquid. The system also includes any of the following: a pressure intensifier having an inlet in flow communication with the pump and an outlet in flow communication with the compression cylinder; a feed eductor in flow communication with the discharge of the pump, with a reservoir containing a portion of the compressor liquid, and with the compression cylinder; a drain eductor in flow communication with the discharge of the pump, with the compression cylinder, and with a reservoir containing a portion of the compressor liquid; and a variable-volume compressor liquid accumulator in flow communication with the discharge of the pump.

8 Claims, 3 Drawing Sheets

ZERO-CLEARANCE ULTRA-HIGH-PRESSURE GAS COMPRESSOR

STATEMENT REGARDING FEDERALLY SPONSORED RESEARCH OR DEVELOPMENT

This invention was made with Government support under DOE Cooperative Agreement No. DE-FC43-02R340595. The Government has certain rights to this invention.

BACKGROUND OF THE INVENTION

Gas compression to ultra-high pressures is required in many industrial processes, in the supply of industrial gases for use at ultra-high pressures, and in specialized ultra-high pressure gas storage systems. The compression of gas to pressures above about 100 psig in such applications typically is effected by positive-displacement compressors that utilize solid pistons or diaphragms and require reliable and efficient seals operating at high pressure differentials. Gas compression requires cooling to remove heat of compression, which may be achieved by interstage cooling between multiple stages of compression. Ultra-high pressure compression applications thus may require many stages of compression for efficient operation. Most piston-type compressors require lubrication between the piston and cylinder, and lubricant may be entrained in the compressed gas, thereby requiring efficient oil removal means downstream of the compressor.

Conventional reciprocating positive-displacement compressors may become less efficient as the discharge pressure increases because of the clearance or dead volume required between the moving compressor element (e.g., piston or diaphragm) and the compressor casing. Because of this clearance volume, a small but significant amount of gas remains in the compressor at the end of the compression stroke, and the pressure energy in this gas is lost during the subsequent intake stroke.

These drawbacks of solid-element reciprocating compressors led to the development of liquid piston gas compressors in which a liquid is pumped into a cylinder to compress gas therein by direct contact between the moving liquid and the gas being compressed. After the gas is compressed and discharged from the cylinder, the liquid is withdrawn and another charge of low-pressure gas flows into the cylinder for compression in a subsequent compression step. Many early liquid piston compressors, for example, were designed for air compression service and used water as the compression liquid. Multiple cylinder liquid compressors have been disclosed which provide a more constant flow of compressed gas, and various types of cooling devices mounted in the compressor cylinders have been used.

There is a need in the field of gas compression, particularly in ultra-high-pressure gas compression, for improved compressor systems that avoid the drawbacks described above for solid-element reciprocating compressors. In particular, there is a need in the industrial gas industry for improved compression systems to provide ultra-high-pressure gas products and for ultra-high-pressure gas storage systems.

BRIEF SUMMARY OF THE INVENTION

This need is addressed by various embodiments of the invention disclosed in the following specification and defined in the appended claims. The liquid piston compressor systems described below utilize several integrated features in compression cycles suited for the compression of gas to ultra-high pressures which may range, for example, up to 100,000 psig.

An embodiment of the invention includes a gas compression system comprising a compression cylinder having a gas inlet, a compressed gas outlet, one or more liquid transfer ports, a pump having a suction and a discharge and a pressure intensifier having an inlet and an outlet. A compressor liquid is used in the system, at least a portion of which is contained in the pump, the pressure intensifier, and the compression cylinder. The system includes piping and valve means adapted to transfer the compressor liquid from the discharge of the pump to any of the one or more liquid transfer ports of the compression cylinder and to the inlet of the pressure intensifier; piping and valve means adapted to transfer the compressor liquid from any of the one or more liquid transfer ports of the compression cylinder to the suction of the pump; and piping means to transfer the compressor liquid from the outlet of the pressure intensifier to any of the one or more liquid transfer ports of the compression cylinder.

This embodiment may further comprise cooling means within the compression cylinder adapted to effect heat transfer therein between the compression liquid and a gas and may further comprise a cooler adapted to cool the compression liquid as it flows between the compression cylinder and the pump. Another feature of this embodiment may include a feed eductor having a high pressure inlet, a low pressure inlet, and an outlet, wherein the high pressure inlet is in flow communication with the discharge of the pump, the low pressure inlet is in flow communication with a reservoir containing a portion of the compressor liquid, and the outlet is in flow communication with any of the one or more liquid transfer ports of the compression cylinder.

The system of this embodiment may further comprise a drain eductor having a high pressure inlet, a low pressure inlet, and an outlet, wherein the high pressure inlet is in flow communication with the discharge of the pump, the low pressure inlet is in flow communication with any of the one or more liquid transfer ports of the compression cylinder, and the outlet of the eductor is in flow communication with a reservoir containing a portion of the compressor liquid. The system may include any of (1) a variable-volume compressor liquid accumulator in flow communication with the discharge of the pump may be included in this system and (2) a compressor liquid reservoir in flow communication with the inlet suction of the pump. The compressor liquid may comprise one or more components selected from the group consisting of water, mineral oil, silicone oil, and fluorinated oil.

Another embodiment of the invention includes a gas compression system comprising (a) a compression cylinder having a gas inlet, a compressed gas outlet, and one or more liquid transfer ports;
(b) a pump having a suction and a discharge;
(c) a feed eductor having a high pressure inlet, a low pressure inlet, and an outlet, wherein the high pressure inlet is in flow communication with the discharge of the pump, the low pressure inlet is in flow communication with a reservoir containing a portion of the compressor liquid, and the outlet is in flow communication with any of the liquid transfer ports of the compression cylinder;
(d) a compressor liquid, at least a portion of which is contained in the pump, the eductor, and the compression cylinder; and
(e) piping and valve means adapted to transfer the compressor liquid from the discharge of the pump to any of the one or more liquid transfer ports of the compression cylinder and the high pressure inlet of the feed eductor; piping and valve means adapted to transfer the compressor liquid from the outlet of the compression cylinder to the suction of the pump; and piping means to transfer the compressor liquid from the outlet of the feed eductor to any of the one or more liquid transfer ports of the compression cylinder.

This embodiment may further comprise a pressure intensifier having an inlet and an outlet, piping and valve means adapted to transfer the compressor liquid from the discharge of the pump to the inlet of the pressure intensifier, and piping means to transfer the compressor liquid from the outlet of the pressure intensifier to any of the one or more liquid transfer ports of the compression cylinder.

This embodiment also may further comprise any of (1) cooling means within the compression cylinder adapted to effect heat transfer therein between the compression liquid and a gas; (2) a cooler adapted to cool the compression liquid as it flows between the compression cylinder and the pump; (3) a drain eductor having a high pressure inlet, a low pressure inlet, and an outlet, wherein the high pressure inlet is in flow communication with the discharge of the pump, the low pressure inlet is in flow communication with any of the one or more liquid transfer ports of the compression cylinder, and the outlet of the drain eductor is in flow communication with a reservoir containing a portion of the compressor liquid; (4) a variable-volume compressor liquid accumulator in flow communication with the discharge of the pump; and (5) a compressor liquid reservoir in flow communication with the inlet suction of the pump. The compressor liquid may be selected from the group consisting of water, mineral oil, silicone oil, and fluorinated oil Yet another embodiment of the invention includes a gas compression system comprising (a) a compression cylinder having a gas inlet, a compressed gas outlet, and one or more liquid transfer ports;

(b) a pump having a suction and a discharge;

(c) a drain eductor having a high pressure inlet, a low pressure inlet, and an outlet, wherein the high pressure inlet is in flow communication with the discharge of the pump, the low pressure inlet is in flow communication with any of the one or more liquid transfer ports of the compression cylinder, and the outlet of the drain eductor is in flow communication with a reservoir containing a portion of the compressor liquid.

(d) a compressor liquid, at least a portion of which is contained in the pump, the eductor, and the compression cylinder; and (e) piping and valve means adapted to transfer the compressor liquid from the discharge of the pump to any of the one or more liquid transfer ports of the compression cylinder and the high pressure inlet of the drain eductor; piping and valve means adapted to transfer the compressor liquid from the outlet of the compression cylinder to the suction of the pump; and piping means to transfer the compressor liquid from the outlet of the drain eductor to a reservoir containing a portion of the compressor liquid.

The system of this embodiment may further comprise a variable-volume compressor liquid accumulator in flow communication with the discharge of the pump.

An alternative embodiment of the invention includes a gas compression system comprising (a) a compression cylinder having a gas inlet, a compressed gas outlet, and one or more liquid transfer ports; (b) a pump having a suction and a discharge; (c) a variable-volume compressor liquid accumulator in flow communication with the discharge of the pump; and (d) a compressor liquid, at least a portion of which is contained in the pump, the accumulator, and the compression cylinder.

Another alternative embodiment includes a gas compression system comprising (a) a compression cylinder having a gas inlet, a compressed gas outlet, one or more liquid transfer ports, and a liquid outlet;

(b) a pump having a suction and a discharge;

(c) a pressure intensifier having an inlet and an outlet, wherein the inlet is in flow communication with the pump and the outlet is in flow communication with the compression cylinder;

(d) a drain eductor having a high pressure inlet, a low pressure inlet, and an outlet, wherein the high pressure inlet is in flow communication with the discharge of the pump, the low pressure inlet is in flow communication with any of the one or more liquid transfer ports of the compression cylinder, and the outlet of the eductor is in flow communication with a reservoir containing a portion of the compressor liquid;

(e) a compressor liquid, at least a portion of which is contained in the pump, the eductors, the reservoir, the pressure intensifier, and the compression cylinder; and (f) piping and valve means adapted to transfer the compressor liquid from the discharge of the pump to any of the inlet of the pressure intensifier and the high pressure inlet of the drain eductor; piping and valve means adapted to transfer the compressor liquid from any of the one or more liquid transfer ports of the compression cylinder to the suction of the pump; and piping means to transfer the compressor liquid from the outlet of the pressure intensifier to any of the one or more liquid transfer ports of the compression cylinder.

In this embodiment, the system may further comprise a feed eductor having a high pressure inlet, a low pressure inlet, and an outlet, wherein the high pressure inlet is in flow communication with the discharge of the pump, the low pressure inlet is in flow communication with a reservoir containing a portion of the compressor liquid, and the outlet is in flow communication with any of the one or more liquid transfer ports of the compression cylinder. This embodiment may further comprise a variable-volume compressor liquid accumulator in flow communication with the discharge of the pump.

Yet another alternative embodiment of the invention includes a gas compression system comprising (a) a compression cylinder having a gas inlet, a compressed gas outlet, one or more liquid transfer ports;

(b) a pump having a suction and a discharge;

(c) a compressor liquid, at least a portion of which is contained in the pump and the compression cylinder; and (d) any of (1) a pressure intensifier having an inlet and an outlet, wherein the inlet is in flow communication with the pump and the outlet is in flow communication with the compression cylinder;

(2) a feed eductor having a high pressure inlet, a low pressure inlet, and an outlet, wherein the high pressure inlet is in flow communication with the discharge of the pump, the low pressure inlet is in flow communication with a reservoir containing a portion of the compressor liquid, and the outlet is in flow communication with any of the one or more liquid transfer ports of the compression cylinder;

(3) a drain eductor having a high pressure inlet, a low pressure inlet, and an outlet, wherein the high pressure inlet is in flow communication with the discharge of the pump, the low pressure inlet is in flow communication with any of the one or more liquid transfer ports of the compression cylinder, and the outlet of the eductor is in flow communication with the pump and with a reservoir containing a portion of the compressor liquid; and (4) a variable-volume compressor liquid accumulator in flow communication with the discharge of the pump.

A related embodiment of the invention includes a method for compressing a gas comprising (a) providing a gas compression system having (1) a compression cylinder having a gas inlet, a compressed gas outlet, one or more liquid transfer ports;

(2) a pump having a suction and a discharge;

(3) a pressure intensifier having an inlet and an outlet; and (4) a compressor liquid, at least a portion of which is contained in the pump, the pressure intensifier, and the compression cylinder;

(b) introducing a gas through the gas inlet into the compression cylinder;

(c) pumping the compressor liquid to provide a pressurized compressor liquid, and introducing the pressurized compressor liquid into the compression cylinder to compress the gas in the compression cylinder;

(d) continuing to pump the compressor liquid to provide pressurized compressor liquid, introducing the pressurized compressor liquid into the inlet of the pressure intensifier, and withdrawing a further pressurized compressor liquid from the outlet of the pressure intensifier;

(e) introducing the further pressurized compressor liquid into the compression cylinder to further compress the gas in the compression cylinder; and (f) withdrawing a compressed gas from the compressed gas outlet of the compression cylinder.

This embodiment may further comprise providing a compressor liquid reservoir, withdrawing the compressor liquid from the compression cylinder, and transferring the compressor liquid into the compressor liquid reservoir; the embodiment also may include providing a feed eductor having a high pressure inlet, a low pressure inlet, and an outlet, wherein the high pressure inlet is in flow communication with the discharge of the pump, the low pressure inlet is in flow communication with the reservoir containing compressor liquid, and the outlet is in flow communication with any of the one or more liquid transfer ports of the compression cylinder, and prior to (c) passing pressurized compressor liquid from the pump into the high pressure inlet and through the eductor, drawing additional compressor liquid from the reservoir into the low pressure inlet of the eductor, withdrawing a combined pressurized compressor liquid from the outlet of the eductor, and transferring the combined pressurized compressor liquid to the compression cylinder.

This embodiment may further comprise cooling the gas in the compression cylinder during any of (c), (d), and (e) by effecting heat transfer between the gas and the compressor liquid. This embodiment may further comprise cooling the compressor liquid during the transferring of the liquid from the compression cylinder into the compressor liquid reservoir. The embodiment may further comprise providing a drain eductor having a high pressure inlet, a low pressure inlet, and an outlet, wherein the high pressure inlet is in flow communication with the discharge of the pump, the low pressure inlet is in flow communication with any of the one or more liquid transfer ports of the compression cylinder, and the outlet of the drain eductor is in flow communication with the reservoir, passing pressurized compressor liquid from the pump into the high pressure inlet and through the drain eductor, drawing compressor liquid from the compression cylinder into the low pressure inlet of the drain eductor, withdrawing a combined compressor liquid from the outlet of the drain eductor, and transferring the combined compressor liquid to the reservoir.

In this embodiment, the compressed gas may be withdrawn from the compressed gas outlet of the compression cylinder at a pressure between 5,000 and 100,000 psig, and the compressed gas may comprise hydrogen.

Another related embodiment of the invention includes a liquid piston gas compression cylinder assembly comprising (a) a cylinder having an upper end and a lower end, a gas inlet and a fluid transfer port in the upper end, and a compressor liquid transfer port in the lower end; (b) heat exchange media disposed in the upper end, and (c) a compression liquid inlet line adapted to introduce a compressor liquid into the cylinder above the heat exchange media and distribute the liquid over the heat exchange media. The compressor liquid inlet line may be disposed coaxially in the cylinder.

The cylinder assembly of this embodiment may include a check valve in fluid communication with the fluid transfer port of the cylinder, wherein the check valve comprises (a) a valve body having an elongated interior chamber with an upper end, a lower end, and an axis oriented in a generally vertical direction;

(b) a first port disposed at the lower end of the interior chamber and a second port disposed at the upper end of the interior chamber, wherein the first port is in fluid communication with the fluid transfer port of the cylinder;

(c) an elongated floatable member having an upper valve seat, a lower valve seat, and an axis, wherein the floatable member is disposed coaxially within the interior chamber and is adapted to float in fluid contained in the interior chamber and move coaxially therein.

Yet another related embodiment includes a check valve comprising (a) a valve body having an elongated interior chamber with an upper end, a lower end, and an axis oriented in a generally vertical direction;

(b) a first port disposed at the lower end of the interior chamber and a second port disposed at the upper end of the interior chamber;

(c) an elongated floatable member having an upper valve seat, a lower valve seat, and an axis, wherein the floatable member is disposed coaxially within the interior chamber and is adapted to float in fluid contained in the interior chamber and to move coaxially therein between the first port and the second port.

The floatable member of (c) may be adapted to seal the lower valve seat against the first port when the floatable member is in a non-floated position; seal the upper valve seat against the second port when the floatable member is in a fully-floated position; and allow flow of fluid into or out of the interior chamber when the floatable member is in a partially-floated position.

DETAILED DESCRIPTION OF THE INVENTION

Figure 1:
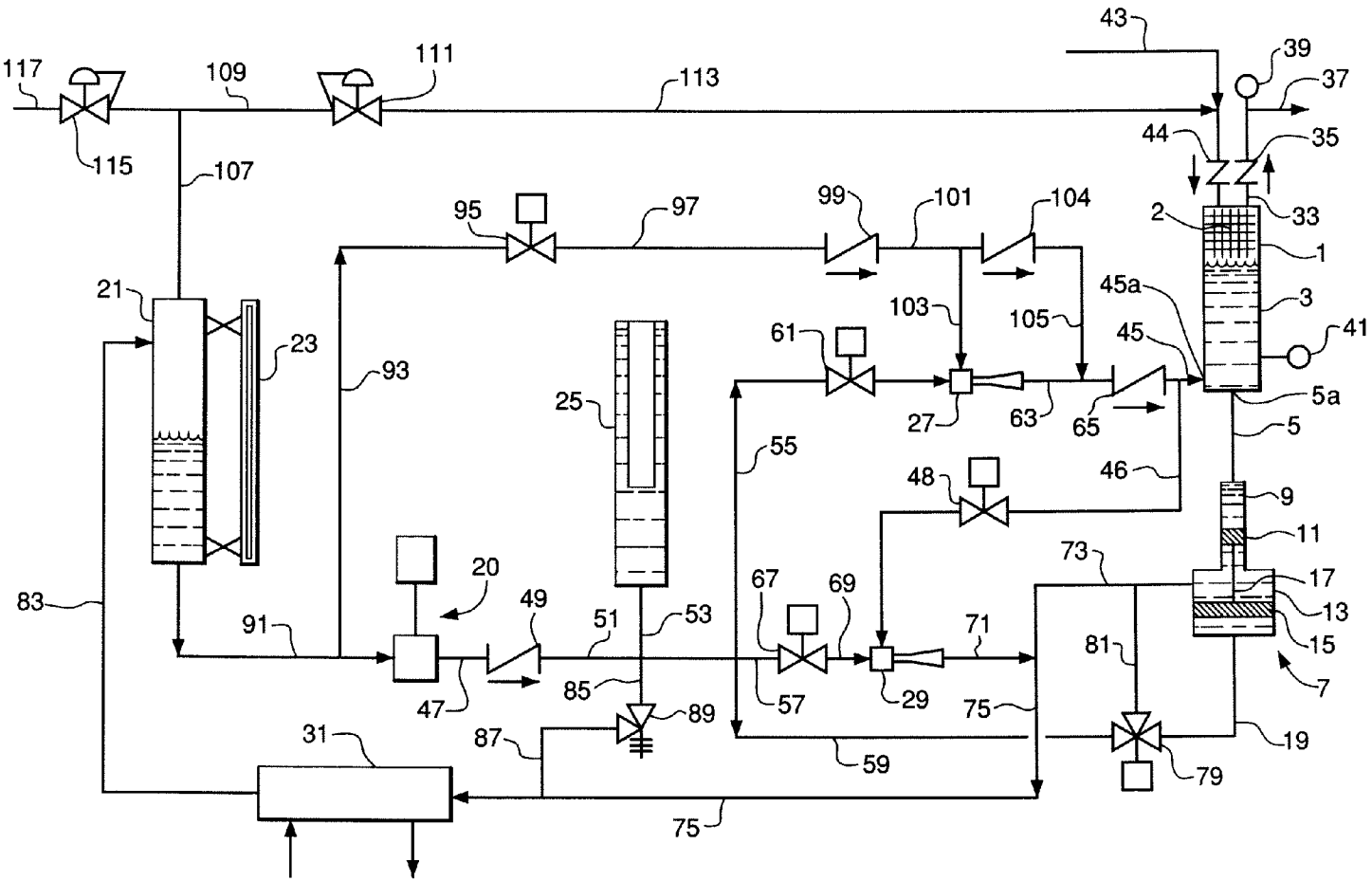
FIG. 1 is a schematic diagram of a compressor system illustrating an embodiment of the present invention.

Gas may be compressed according to embodiments of the invention by operating a repeating compression cycle that utilizes one or more liquid-filled compression cylinders with various combinations of liquid pressure intensifiers and liquid-driven eductors for filling and draining the compression cylinders. An exemplary embodiment of the invention is illustrated in FIG. 1 in which gas is compressed in compression cylinder 1 by the cyclic filling and draining of compressor liquid 3 in the cylinder. Compressor liquid may be introduced into and withdrawn from the cylinder at various pressures in a compressor cycle as discussed below.

Compression cylinder 1 has an upper end and a lower end, the upper end has a gas inlet and a gas outlet, and the lower end has at least one compressor liquid transfer port for the introduction and/or withdrawal of compressor liquid. Alternatively, the location of the gas inlet may be at the bottom of the cylinder. The cylinder also has a compressor liquid inlet line, shown here at the lower end of the cylinder. In one embodiment, the cylinder is part of a liquid piston gas compression cylinder assembly comprising a cylinder having an upper end and a lower end, a gas inlet and a gas outlet in the upper end, and a compression liquid transfer port in the lower end; heat exchange media disposed in the upper end, and a compression liquid inlet line adapted to introduce a compression liquid into the cylinder above the heat exchange media and distribute the liquid over the heat exchange media. The compression liquid inlet line may be disposed coaxially in the cylinder.

Pressure intensifier 7 is connected to compression cylinder by line 5 which is connected to a port in the cylinder. Pressure intensifier 7, which is an exemplary type of pressure intensifier that may be used with this system, comprises small cylinder 9, small piston 11, large cylinder 13, and large piston 15. Small piston 11 and large piston 15 are joined by piston rod 17 so that the two pistons move in tandem. Small cylinder 9 and large cylinder 13 are filled with the compressor liquid on both sides of pistons 11 and 15. Pressure intensifier 7 operates to magnify the pressure supplied to large cylinder 13 via line 19, thereby discharging higher pressure liquid from small cylinder 9 via line 5. The ratio of the pressure between the compressor liquid in lines 5 and 19 is generally equal to the ratio of the cross-sectional areas of pistons 15 and 11, respectively. Typically, this ratio may range from 3:1 to 25:1. Pressure intensifier 7 has an inlet and an outlet, but may have additional inlets and outlets (not shown). In the present disclosure, the indefinite articles "a" and "an" mean one or more when applied to any feature of the present invention described in the specification and claims. The use of "a" and "an" does not limit the meaning to a single feature unless such a limit is specifically stated.

Other types of pressure intensifiers may be used to generate a higher pressure liquid output stream from a lower pressure liquid input stream The meaning of "pressure intensifier" as used herein is a positive-displacement mechanical hydraulic device with a low pressure inlet and a high pressure outlet that is driven by a liquid introduced at a lower pressure or in a lower pressure range. The driving liquid operates on large piston 15 and energy is extracted from this liquid in the form of work. The work is transferred to the driven liquid which exits the intensifier at a higher pressure due to the operation of smaller piston 11. Some intensifiers are designed such that this operation can be accomplished automatically and sequentially any number of times, such that the amount of driven liquid passing through the intensifier is not limited to a single stroke. Typically, the low pressure liquid and the high pressure liquid are identical in composition and properties.

The compression system further comprises pump 20, which may be any type of positive displacement pump capable of delivery pressures up to 3000 psig, such as, for example, a Rexroth vane or gear pump. The system also may include liquid reservoir 21 having optional level indicator or sight glass 23, variable-volume compressor liquid accumulator 25, feed eductor 27, drain eductor 29, and compressor liquid cooler 31. Liquid accumulator 25 may be a bladder-type unit in which the bladder volume changes as liquid enters and exits the accumulator. Alternatively, the accumulator may utilize a sliding piston to vary the accumulator volume. The eductors may be any type known in the art for liquid service and may be, for example, liquid or jet eductors such as those manufactured by Fox Valve, Inc.

When all of these components are utilized in combination, piping and valves are utilized for liquid and gas flow control as follows. Compressed gas is withdrawn from compression cylinder 1 via line 33, gas-activated check valve 35, and delivery line 37. Low pressure gas to be compressed is provided to compression cylinder 1 via line 43 and check valve 44. Liquid sensors 39 and 41 may be installed on the cylinder and gas outlet line as shown to monitor the compressor liquid level during a compression cycle as described below. Compressor liquid may be introduced and withdrawn from compression cylinder 1 via line 45 connected to liquid transfer port 45*a* in the cylinder; optionally, this line may be connected to line 5 that is connected to liquid transfer port 5*a*. Line 45 and the low pressure inlet of drain eductor 29 are connected via line 46 and valve 48.

Alternatively, gas-activated check valve 35 may be replaced by a dual-mode gas-activated and liquid-activated check valve having a first valve seat or seal which, when open, allows gas and liquid to flow out of compression cylinder 1 and also allows liquid to flow back into compression cylinder 1. This check valve has a lower port that is in fluid communication via line 33 to a fluid transfer port at the top of cylinder 1 and an upper port connected to discharge line 37. The valve has a second valve seat or seal which, when open, allows the gas passing from the first seat to flow out of the system through delivery line 37. Disposed within the valve body is a vertically floatable member having a first end and a second end, wherein the first end is adapted to seal against the first valve seat and the second end is adapted to seal against the second valve seat.

The first valve seat in dual-mode check valve 35 opens at a predetermined gas product delivery pressure (i.e., the pressure in product gas delivery line 37) and allows gas to flow through the valve body and second valve seat into delivery line 37. The first valve seat allows gas flow as well as liquid flow. When liquid flows into the valve body, the vertically floatable member floats, rises, and eventually seals at the second valve seat, thereby preventing both gas and liquid flow through the valve. The pressure begins to rise rapidly and a pressure sensor initiates a cylinder depressurization step as described below. When the liquid pressure in compression cylinder 1 is relieved and liquid is drained therefrom, the liquid in the body of valve 37 drains back into compression cylinder 1, the vertically floatable member falls, and eventually seals at the first valve seat A detailed description of this valve is given later.

Pressurized compressor oil flows from pump 20 via line 47, check valve 49, and line 51. Compressor liquid accumulator 25 is connected to line 51 via line 53. Line 51 branches into lines 55, 57, and 59 to deliver compressor liquid to various destinations during different portions of the compressor cycle as described below. Line 55 is connected via valve 61 to the high pressure inlet of feed eductor 27. The outlet of feed eductor 27 is connected via line 63 and check valve 65 to inlet line 45 to compression cylinder 1. Line 57 is connected via valve 67 and line 69 to the high pressure inlet of drain eductor 29. The outlet of drain eductor 29 is connected to line 71, which branches into lines 73 and 75. Line 59 is connected via two-way valve 79 to line 19, which is connected to the bottom section of large cylinder 13 of pressure intensifier 7, and is connected via line 81 to line 73. In a first position or through position, valve 79 connects lines 19 and 59 while blocking line 81, and in a second position or side position, valve 79 connects lines 19 and 81 while blocking line 59.

Line 75 is connected to optional cooler 31, which is connected via line 83 to compressor liquid reservoir 21. Optionally, lines 51 and 75 are connected via lines 85 and 87 to safety relief valve 89. The liquid outlet of compressor liquid reservoir 21 is connected via line 91 to the inlet of pump 20. Line 93 connects line 91 via valve 95, line 97, check valve 99, line 101, and line 103 to the low pressure inlet of feed eductor 27. Line 101 also connects via check valve 104 and line 105 with the outlet of feed eductor 27. The upper outlet of reservoir 21 is connected to line 43 via line 107, 109, backpressure control valve 111, and line 113. Additional pressure regulator 115 connects pressurization gas inlet line 117 with line 109.

The system is filled with an appropriate compressor liquid that is compatible with the gas being compressed and with the seals used in pump 20, pressure intensifier 7, and the various valves and fittings in the system. The compressor liquid preferably has a low vapor pressure at the normal operating temperature (typically near ambient). A portion of the compressor liquid typically fills pump 20, liquid accumulator 25 (excluding the bladder if a bladder-type accumulator is used), pressure intensifier 7, and connected liquid piping and valving. Compression cylinder 1 and reservoir 21 are partially filled during certain cycle steps as described below.

The compressor system of FIG. 1 is operated cyclically through a number of repeating steps in which gas is compressed by alternately filling and draining compression cylinder 1 to compress low pressure gas supplied via line 43 and provide compressed gas via product line 37. The compressor system may provide compressed gas at any pressure up to the maximum pressure rating of compression cylinder 1 and associated piping. Typically, the system is operated to compress gas to ultra-high pressures, i.e., pressures above 5000 psig, and may be operated up to pressures as high as 100,000 psig.

Figure 2:
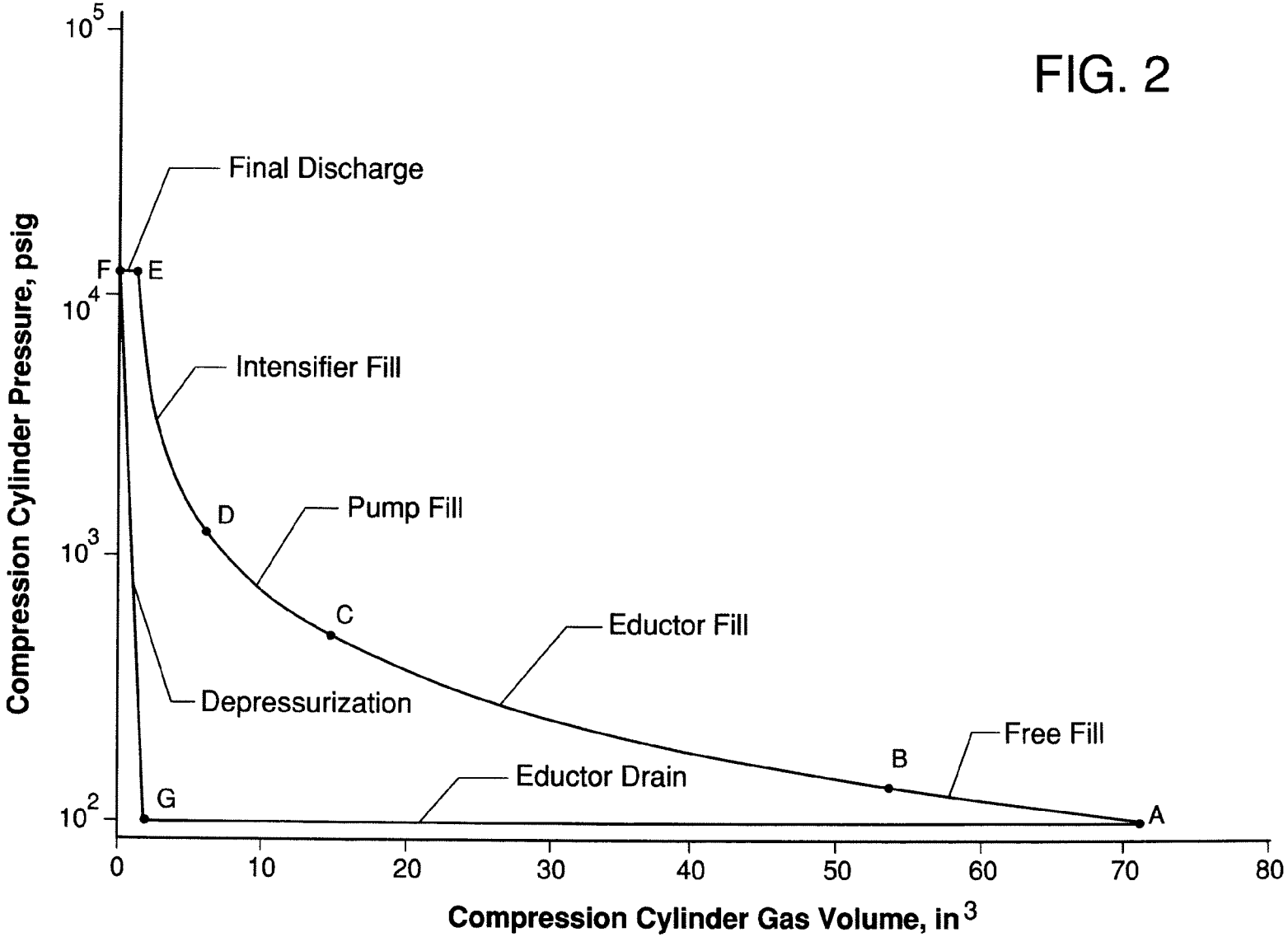
FIG. 2 is a plot of pressure vs. volume for a compression cylinder in an exemplary compression cycle utilizing the compressor system of FIG. 1.

An exemplary compression cycle may be described with reference to FIGS. 1 and 2 to illustrate the compression system and process. FIG. 2 is an exemplary pressure-volume plot (not necessarily to scale) for compression cylinder 1 showing the curve ABCDEFG that describes a typical pressure-volume relationship in cylinder 1 during a single compression cycle. The cycle steps, valve positions, and liquid sensor status conditions for this exemplary cycle are summarized in Table 1.

TABLE 1

Compression Cycle Valve Position And Liquid Sensor Status (See FIGS. 1 and 2)

| | | Valve Number and Position | | | | | Sensor Status | |
|---|---|---|---|---|---|---|---|---|
| Step | Description | 95 | 61 | 48 | 67 | 79 | 39 | 41 |
| 1 | Free Fill | O | C | C | C | Side | dry | dry/wet |
| 2 | Eductor Fill | O | O | C | C | Side | dry | wet |
| 3 | Pump Fill | O | O | C | C | Side | dry | wet |
| 4 | Pressure Intensifier Fill | C | C | C | C | Thru | dry | wet |
| 5 | Final Gas Discharge | C | C | C | C | Thru | wet | wet |
| 6 | Depressurization | C | C | O | O | Side | wet/dry | wet |
| 7 | Eductor Drain | C | C | O | O | Side | dry | wet/dry |

Note:
O = open,
C = closed

The cycle begins at point A on the pressure-volume plot of FIG. 2 and proceeds through seven cycle steps as summarized in Table 1 and as described below with reference to the operating points on the plot.

1) Free Fill (A to B)

This step begins at point A of FIG. 2 with the liquid level of compressor cylinder 1 at or below liquid sensor 41 and typically above the ports connected to lines 5 and 45. The cylinder initially contains low pressure gas which was drawn in through line 43 and check valve 44 during the drain steps of the previous cycle. The initial pressure in compression cylinder 1 is typically 2 to 200 psig, and is lower than the pressure in reservoir 21. The pressure in reservoir 21 is maintained at a pressure in the range of 5 to 250 psig by pressurization gas admitted via line 117 and controlled by backpressure regulators 111 and 115. This pressurization gas may be the same gas as that being compressed in cylinder 1. Pump 20 runs continuously during this step and all following steps.

During this free fill step, valve 95 is open, valves 48, 61, and 67 are closed, and valve 79 is in the side position (i.e., connecting lines 19 and 81). The pressure of the gas in cylinder 1 increases along the curve from point A to point B of FIG. 2 as compressor liquid flows from reservoir 21 via line 91, line 93, valve 95, line 97, check valve 99, line 101, check valve 104, line 105, check valve 65, and line 45. The free fill step ends at point B of FIG. 2 when the pressure in cylinder 1 approaches the pressure in reservoir 21. The duration of the free fill step may be between 1 and 10 seconds.

2) Eductor Fill (B to C)

Valve 61 is opened, pump 20 draws liquid from reservoir 21 via line 91, and the pump delivers pressurized liquid through line 47, check valve 49, line 51, line 55, valve 61, line 69, feed eductor 27, line 63, check valve 65, and line 45 into cylinder 1. Feed eductor 27 draws additional liquid via line 93, valve 95, line 97, check valve 99, line 101, and line 103. The use of feed eductor 27 magnifies the pump flow by a factor of 2 to 7, which reduces the fill time of this step and reduces the pump head and motor size of pump 20. The use of feed eductor 27 also may result in more constant utilization of the flow/head characteristics of the pump and the power capacity of the motor. The eductor fill step may not be used in certain applications, and therefore may be considered an optional step. The liquid continues to fill cylinder 1 and compresses the gas therein until the pressure differential across the eductor becomes insufficient to draw liquid through line 103. The eductor fill step ends at point C of FIG. 2 at a pressure typically in the range of 400 to 1000 psig. The duration of the eductor fill step may be between 5 and 20 seconds.

3) Pump Fill (C to D)

As feed eductor 27 stops drawing liquid through line 103, pumped liquid continues to flow through the eductor, line 65, check valve 65, and line 45. The flow of liquid into cylinder 1 continues to compress the gas therein until the gas pressure approaches the discharge pressure of pump 20, typically in the range of 1000 to 6000 psig, and the step then ends at point D of FIG. 2. The duration of the pump fill step may be between 5 and 20 seconds.

4) Pressure Intensifier Fill (D to E)

Valves 61 and 95 close and two-way valve 79 moves to the through position (i.e., connecting lines 19 and 59). Valves 48 and 67 remain closed. Pressurized fluid from pump 20 then flows through line 59, valve 79, and line 19 into the bottom of large cylinder 15 of pressure intensifier 7. This moves large piston 15 and small piston 11 upward, thereby increasing the pressure in small cylinder 9 and sending higher pressure liquid via line 5 into cylinder 1. This liquid further compresses the gas in cylinder 1 until the desired maximum gas product pressure is reached, typically in the range of 5,000 to 20,000 psig. This completes the pressure intensifier fill step at point E of FIG. 2. The duration of the pressure intensifier fill step may be between 10 and 60 seconds.

5. Final Discharge (E to F)

High pressure liquid from pressure intensifier 7 continues to fill cylinder 1 as high pressure product gas is withdrawn through line 33, check valve 35, and product line 37. Check valve 35 is designed to open at the desired pressure of the product gas delivered through line 37. Two-way valve 79 remains in the through position (i.e., connecting lines 19 and 59). Liquid fill continues until liquid reaches liquid sensor 39, and valve 48 then opens, effectively ending the final discharge step at point F of FIG. 2. After a downstream product valve (not shown) in line 37 is closed, liquid trapped in the line between check valve 35 and liquid sensor 39 may be drained via a drain line (not shown) and returned to reservoir 21. Alternatively, check valve 35 may be a dual-mode gas-activated and liquid-activated check valve as described below. The duration of the final discharge step between points E and F may be between 1 and 10 seconds.

6. Depressurization (F to G)

Valves 48 and 67 open, and two-way valve 79 changes to the side position (i.e., connecting lines 19 and 81). The pressure in cylinder 1 drops rapidly and the step ends at point G as the pressure in cylinder 1 approaches the pressure of the feed gas provided via line 43. The pressure-volume line FG of FIG. 2 actually falls very close to the vertical pressure axis, but is shown at a small distance from the axis for illustration purposes. A small amount of liquid may drain from cylinder 1 during this step via line 45, line 46, valve 48, drain eductor 29, line 71, line 75, cooler 31, and line 83 into reservoir 21. During depressurization, dissolved gas may be evolved from the compressor liquid and the evolved gas gathers in the upper section of the reservoir. This evolved gas is recycled via lines 107, 109, and 113 to compression cylinder 1. Also, a small amount of dissolved gas may be evolved from the liquid in cylinder 1 during this step and this gas remains in the cylinder to be compressed in the next cycle.

7. Eductor Drain (G to A)

Liquid from pump 20 flows through drain eductor 29, thereby drawing liquid from cylinder 1 via line 45, line 46, and valve 48 into the low pressure inlet of the eductor. Liquid then returns via line 71, line 75, cooler 31, and line 83 into reservoir 21. As liquid is withdrawn, cylinder 1 is filled with low pressure feed gas via line 43. The step ends at point A, which may occur, for example, when the liquid level in cylinder 1 drops below liquid sensor 41.

The flow rate of compressed gas product may be varied by specifying the sizes of compression cylinder 1 and pump 20. The product flow rate for a specifically-sized system may be varied by varying the duration of the cycle steps, for example during periods of reduced demand for the compressed product. The lengths of the various cycle steps can be optimized to minimize pressure fluctuations and the size of accumulator 25 needed downstream of pump 20.

As liquid is introduced into compression cylinder 1 during steps 1 through 4, the temperature of the gas being compressed will increase unless it is sufficiently cooled. Cooling may be effected by the use of cooling means installed within cylinder 1. In one embodiment, heat exchange media 2 (for example, structured metal heat exchange packing, random metal heat exchange packing, extruded metal monolith, or extruded heat exchange fins) may be installed in compression cylinder 1 at any location between the top of the cylinder and liquid sensor 41. For example, the heat exchange media may be installed in the upper 50% of cylinder 1. Liquid line 5 may be extended coaxially through the cylinder to a point near the top, where the liquid is sprayed or distributed over the heat exchange media. As the liquid flows downward over the heat exchange media and the gas being compressed contacts the liquid, the heat of compression is transferred from the gas to the liquid and to the heat exchange media, thereby allowing the compression process to approach isothermal conditions. In another embodiment, the liquid may be pumped through the interior of the heat exchange media, exiting at the bottom. In this embodiment, the heat exchanger element is actively cooled by the liquid, and the gas is compressed by a rising column of liquid. In another embodiment, a cooling coil or heat exchanger using an external coolant (not shown) may be installed at any location in the interior of compression cylinder 1 (with or without the use of the heat exchange material described above) to provide cooling by indirect heat exchange with the gas and/or the liquid during steps 1 through 4.

Alternatively, cooling of the gas in the cylinder during compression may be effected by spraying the compressor liquid into the cylinder without the use of heat exchange media. In this alternative, heat transfer occurs directly between the liquid and gas as liquid droplets fall through the gas being compressed.

Thus the heat transfer means installed within cylinder 1 may include any combination of (a) heat transfer media at any location in the cylinder, (b) apparatus for spraying or distribution of the liquid into the cylinder above the liquid level therein, and (c) a cooling coil installed at any location in the cylinder to provide indirect cooling to the liquid and/or the gas being compressed.

Compressor liquid returning to reservoir 21 during drain steps 6 and 7 may be cooled in cooler 31 to remove the heat of compression absorbed by the liquid during compression steps 1 through 4. The liquid temperature after cooling may be selected depending on specific compression conditions, the temperature-viscosity relationship of the compressor liquid, and other process conditions. This temperature may range between −80° F. and 300° F., and the temperature may be selected such that the gas temperature during steps 1 through 4 does not exceed a selected maximum temperature.

Figure 3C:
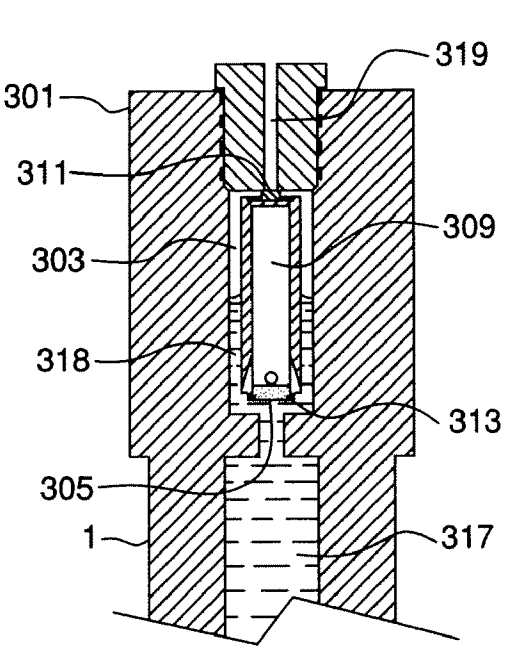
FIG. 3C is a sectional view of the dual-mode check valve optionally used at the gas outlet end of the compression cylinder during yet another portion of the gas compression cycle.
Figure 3B:
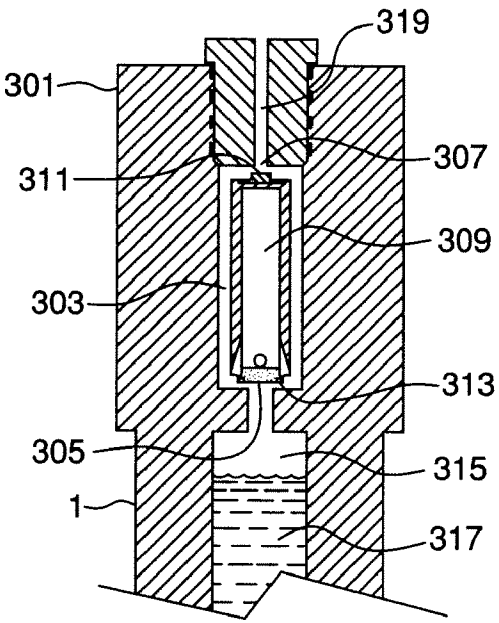
FIG. 3B is a sectional view of the dual-mode check valve optionally used at the gas outlet end of the compression cylinder during another portion of the gas compression cycle.
Figure 3A:
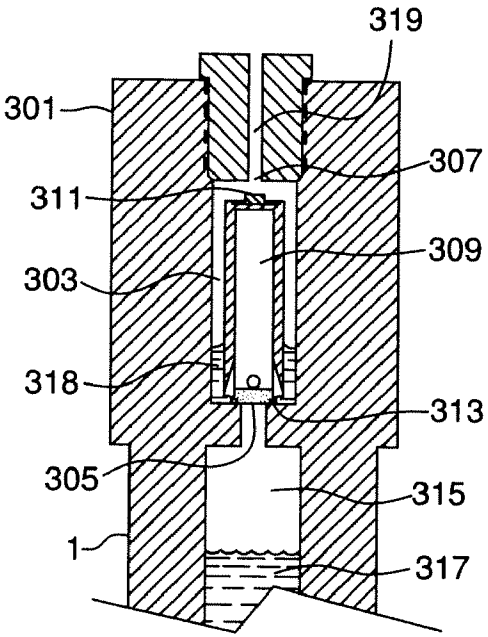
FIG. 3A is a sectional view of a dual-mode check valve optionally used at the gas outlet end of the compression cylinder during a portion of a gas compression cycle.

The alternative type of check valve 35 discussed above is illustrated in FIGS. 3A, 3B, and 3C, which are sectional views of the valve during steps 4, 5, 6, and 7 described above with reference to Table 1. Referring to FIG. 3A, valve body 301 has elongated interior chamber 303 with an upper end, a lower end, and an axis oriented in a generally vertical direction. The term "generally vertical direction" means that the axis of valve body 301 is preferably vertical but may deviate from the vertical by up to about 15 degrees. The interior chamber has first port 305 disposed at the lower end of the interior chamber and second port 307 disposed at the upper end of the interior chamber.

Elongated floatable member 309 having upper valve seat 311 and lower valve seat 313 is disposed coaxially within interior chamber 303 and is adapted to float in fluid contained in the interior chamber and to move coaxially therein between first port 305 and second port 307. Valve body 301 may be attached directly to, or alternatively may be an integral part of, compressor cylinder 1.

Floatable member 309 is adapted to (1) seal the lower valve seat against the first port when the floatable member is in a non-floated position; (2) seal the upper valve seat against the second port when the floatable member is in a fully-floated position; and (3) allow flow of fluid into and out of the interior chamber when the floatable member is in a partially-floated position. These three functions are illustrated in FIGS. 3A, 3C, and 3B, respectively.

FIG. 3A illustrates the operation of the check valve during pressure intensifier fill step (Table 1, Step 4) during which gas is compressed in cylinder 1 to the highest pressure range. During this step, gas 315 is being compressed by rising liquid 317 in the cylinder. During this step, floatable member 309 is in a non-floated condition and the gas pressure in interior chamber 303 is the discharge product gas pressure because the interior chamber is in fluid communication with the downstream product gas destination. Valve seat 313 thus seals against port 305. Residual compressor liquid 318 is trapped in interior chamber 303 from the previous compression cycle.

When the gas pressure in cylinder 1 reaches and exceeds the gas pressure in interior chamber 303, the seal provided by valve seat 313 and port 305 opens. Compressed gas product then flows through the valve and exits via exit bore 319 as shown in FIG. 3B, and flows to line 37 of FIG. 1. This occurs during the final gas discharge step (Table 1, Step 5). Residual compressor liquid 318 trapped in interior chamber 303 from the previous compression cycle can flow back into cylinder 1 during this step.

The liquid in cylinder 1 continues to rise, eventually passes through port 305, and flows into interior chamber 303, thereby placing floatable member 309 in a partially-floated position. As compression liquid continues to flow into the interior chamber, the floatable member reached a fully-floated position, which pushes upper seat 311 against port 307 and seals the interior chamber at the discharge pressure of pump 20 (FIG. 1). This is shown in FIG. 3C. At this point, a pressure sensor on the compression liquid (not shown) immediately initiates the depressurization step (Step 6, Table 1). FIG. 3C thus illustrates a feature of the invention wherein compression cylinder 1 operates at zero clearance at the end of the compression step wherein no gas remains in cylinder 1 at the end of the compression step.

Other embodiments of the compression cycle and system may be utilized for specific process requirements. For example, two or more compression cylinders could be used in parallel staggered operation. In one embodiment, two cylinders could be used such that one cylinder operates on pressure intensifier fill step 4 while the other operates on steps 5, 6, 7, 1, 2, and 3. In another embodiment, two or more compression cylinders may be operated in a staged arrangement wherein gas is compressed to an intermediate pressure in one compression cylinder and to the final product pressure in another compression cylinder.

Various combinations of the compressor components may be used depending on economic and process requirements. All combinations require the compressor liquid, pump 20, and compression cylinder 1, and include any of the pressure intensifier, feed eductor, drain eductor, and compressor liquid accumulator. In one alternative embodiment, the system uses pump 20, compressor cylinder 1, and pressure intensifier 7 along with associated piping and valves; any of compressor liquid accumulator 25, feed eductor 27, and drain eductor 29 would be optional and may not be required. In another alternative embodiment, the system uses pump 20, compressor cylinder 1, and feed eductor 27 along with associated piping and valves.

In yet another alternative embodiment, the system uses pump 20, compressor cylinder 1, and drain eductor 29; any of compressor liquid accumulator 25, feed eductor 27, and pressure intensifier 7 would be optional and may not be required. In a further alternative embodiment, the system uses pump 20, compression cylinder 1, and compressor liquid accumulator 25; any of feed eductor 27, drain eductor 29, and pressure intensifier 7 would be optional and may not be required. In any of the above embodiments, reservoir 21 and cooler 31 may be considered optional features to be used as desired.

The compressor liquid used in the process should meet several criteria. The liquid should have a low vapor pressure at the compressor operating temperature to minimize the concentration of vaporized liquid in the final compressed gas product, and the gas being compressed should have a low solubility in the compressor liquid. Also, the liquid should be compatible with the seals in the pump, pressure intensifier, and valves used in the system. In addition, the liquid should be compatible with downstream processes that use the compressed gas product in view of potential carryover of small concentrations of vaporized liquid. If the downstream process that uses the compressed gas product is not compatible with the compressor liquid, a final gas cleanup step may be used such as, for example, an adsorbent guard bed or a low temperature condenser or freezeout system.

The compressor liquid may be selected, for example, from the group consisting of water, mineral oil, silicone oil, fluorinated oil, or any other natural or synthetic oil.

The compressor system described above may be used to compress any gas or gas mixture that is compatible with the compressor liquid. In one exemplary application, the compressor may be used to provide compressed hydrogen at pressures up to 20,000 psig for ultra-high-pressure gas storage for fuel cell applications.

EXAMPLE

The following Example illustrates an embodiment of the present invention but does not limit the invention to any of the specific details described therein. In this Example, the compressor system of FIG. 1 and the compressor cycle of Table 1 are used to compress hydrogen from 100 psig to 14,000 psig at a flow rate of 1 $Nm^3$/hr. Compression cylinder 1 has an internal diameter of 1.5 inches and a length of 42.7 inches and is operated in a cycle with a total duration of 30 seconds. Pump 20 is a gear pump having a design flow of 1.2 gpm and a maximum delivery pressure of 1,500 psig. The pump is used to pressurize the compressor liquid from a pressure of 140 psig in reservoir 21 to about 1,400 psig. Accumulator 25 is used downstream of the pump to store and pressurize the compressor liquid when the pump is blocked off. Pressure intensifier 7 raises the liquid pressure further from 1,400 psig to 14,000 psig. Compression cylinder 1 receives feed hydrogen from an inlet surge bottle (not shown) via line 43 at 100 psig and discharges the hydrogen through line 37 to a discharge surge bottle (not shown) at 14,000 psig.

Details of the exemplary compressor cycle are given in Table 2 for a cycle with a 30 second duration. Pump 20 runs continuously and different steps in the cycle are implemented by opening and closing valves 48, 61, 67, and 95 and by switching the position of two-way valve 79 as earlier described. The valve action may be initiated based on time delays from a programmable logic controller (PLC) and/or signals from liquid sensors 39 and 41. At the beginning of the cycle, valve 95 is open, valves 48, 61, and 67 are closed, and valve 79 is in the side position.

TABLE 2

Example Compression Cycle
Step Duration and Pressure

| Step | Description | Duration, sec | Cylinder Pressure, psig Initial | Final |
|---|---|---|---|---|
| 1 | Free Fill | 2.1 | 100 | 140 |
| 2 | Eductor Fill | 5.6 | 140 | 590 |
| 3 | Pump Fill | 1.7 | 590 | 1,383 |
| 4 | Pressure Intensifier Fill | 11.4 | 1,383 | 14,000 |
| 5 | Final Gas Discharge | 1.3 | 14,000 | 14,000 |
| 6 | Depressurization | 1.0 | 14,000 | 100 |
| 7 | Eductor Drain | 6.9 | 100 | 100 |

Referring now to FIG. 1 and Table 2, free fill (step 1) is initiated, compression cylinder 1 begins to fill, and the pressure is increased therein from 100 psig to 140 psig by compressor liquid flowing from reservoir 21 via line 91, line 93, valve 95, line 97, check valve 99, line 101, check valve 104, line 105, check valve 65, and line 45. The liquid is carried to the top of the cylinder through a coaxial tube (not shown) inside the cylinder and sprayed on a metal heat transfer element (not shown) at the top of the cylinder. The metal heat transfer element, which stores some of the heat generated from the previous compression step, is cooled during the liquid transfer. At the end of step 1, having a duration of 2.1 seconds, valve 61 is opened to begin the next step.

Feed eductor fill (step 2) proceeds as compressor liquid flows from pump 20 through line 47, check valve 49, line 51, line 55, valve 61, feed eductor 27, line 63, check valve 65, and line 45 into cylinder 1. Feed eductor 27 draws additional liquid via line 93, valve 95, line 97, check valve 99, line 101, and line 103. The pressure in cylinder 1 rises from 140 psig to 590 psig in 5.6 seconds during this step, which ends when the feed eductor stops drawing liquid through line 103 at 590 psig.

The flow of compressor liquid continues as above as the cycle moves into the pump fill period, step 3. The liquid flows through eductor 27 (but no liquid is drawn into the eductor via line 103), line 63, check valve 65, and line 45, and cylinder 1 is filled to 1383 psig. This step lasts for 1.7 seconds and ends when valve 61 is closed and valve 79 is switched to the through position to direct liquid via line 19 to pressure intensifier 7.

During step 4, the pressure intensifier fills cylinder 1 via line 5 for 11.4 seconds to achieve a final pressure of 14,000 psig, at which point check valve 35 opens and the liquid flows up to liquid sensor 39 line while pushing the pressurized gas out of the cylinder through line 37. Liquid entrained with the gas is captured in a discharge surge bottle (not shown) and returned to reservoir 21. When sensor 39 is wet, the pressurization steps are complete, and the cycle proceeds to the depressurization and drain steps.

Valve 48 and valve 67 are opened, valve 79 is switched to the side position, and the depressurization step (step 6) is started. Cylinder 1 depressurizes rapidly to 100 psig during a 1.0 second period by the flow of liquid through line 45, line 46, valve 48, drain eductor 29, line 71, line 75, cooler 31, and line 83 into reservoir 21. This flow is driven by the pressure difference between cylinder 1 and eductor 29. Cooler 31 cools the liquid during depressurization to remove the heat it picked up from the gas and the metal heat transfer element during gas compression. The cooled liquid leaving cooler 31 is at ambient temperature.

The cycle now proceeds through the eductor drain period (step 7, having a duration of 6.9 seconds) during which liquid flows to reservoir 21 from cylinder 1 via line 45, line 46, valve 48, drain eductor 29, line 71, line 75, cooler 31, and line 83 into reservoir 21 until the liquid level in cylinder 1 reaches liquid sensor 41. During this step, the cylinder pressure is roughly 100 psig while check valve 44 admits a fresh batch of hydrogen via line 43. This completes the eductor drain step having a duration of 6.9 seconds and completes the 7 step cycle having a total duration of 30 seconds.

In this Example, accumulator 25 having a capacity of 2 gallons is used downstream of pump 20 and the pressure in accumulator 25 varies between 1,347 psig and 1,424 psig during the cycle. The cycle segments are designed to maintain a nearly constant accumulator pressure during the feed eduction fill, direct pump fill, pressure intensifier fill, and final gas discharge steps. This optimization improves the energy efficiency of the compressor.

Feed eductor 27 provides extra flow in certain pressure ranges during the pressurization step. This eductor uses a nozzle diameter of 0.045 inch, a gauntlet diameter of 0.097 inch, and a gauntlet length of 0.523 inch, and can operate in an eductor discharge pressure range of 405 psig to 590 psig. The corresponding flow range of the mixed discharge liquid in line 63 may be 1.21 gpm to 2.74 gpm, which exceeds pump 20 flow capacity of 1.20 gpm. Drain eductor 29 provides extra flow during the entire eductor drain step 7, as the pressures are constant during this segment. A mixed discharge flow of 7.93 gpm is estimated when a drain eductor with a nozzle diameter of 0.040 inch, a gauntlet diameter of 0.249 inch, and a gauntlet length of 2.090 inch is used to transfer the liquid from cylinder 1 at 100 psig to reservoir 21 at 140 psig.

The pressure-volume (PV) diagram for the cylinder during the entire cycle is shown in FIG. 2. Most of the volume increase and decrease occurs at lower cylinder pressures while most of the compression and decompression occurs at lower cylinder volume.

The compressor liquid used in this Example is Krytox-101, which is produced by DuPont and distributed by TMC Industries. This is a clear, colorless, perfluoropolyether (PFPE) oil having a low vapor pressure and a low viscosity, which are desired properties for this application. The maximum volatility of this liquid at 150° F. is 2% in 22 hours (by ASTM D972 method) and its viscosity at 68° F. is 16 cST (by ASTM D445 method).

The invention claimed is:

1. A gas compression system comprising (a) a compression cylinder having a gas inlet, a compressed gas outlet, one or more liquid transfer ports;

(b) a pump having a suction and a discharge;

(c) a pressure intensifier having an inlet and an outlet;

(d) a compressor liquid, at least a portion of which is contained in the pump, the pressure intensifier, and the compression cylinder; and (e) piping and valve means adapted to transfer the compressor liquid from the discharge of the pump to any of the one or more liquid transfer ports of the compression cylinder and to the inlet of the pressure intensifier; piping and valve means adapted to transfer the compressor liquid from any of the one or more liquid transfer ports of the compression cylinder to the suction of the pump; and piping means to transfer the compressor liquid from the outlet of the pressure intensifier to any of the one or more liquid transfer ports of the compression cylinder.

2. The system of claim 1 which further comprises cooling means within the compression cylinder adapted to effect heat transfer therein between the compression liquid and a gas.

3. The system of claim 1 which further comprises a cooler adapted to cool the compression liquid as it flows between the compression cylinder and the pump.

4. The system of claim 1 which further comprises a feed eductor having a high pressure inlet, a low pressure inlet, and an outlet, wherein the high pressure inlet is in flow communication with the discharge of the pump, the low pressure inlet is in flow communication with a reservoir containing a portion of the compressor liquid, and the outlet is in flow communication with any of the one or more liquid transfer ports of the compression cylinder.

5. The system of claim 1 which further comprises a drain eductor having a high pressure inlet, a low pressure inlet, and an outlet, wherein the high pressure inlet is in flow communication with the discharge of the pump, the low pressure inlet is in flow communication with any of the one or more liquid transfer ports of the compression cylinder, and the outlet of the eductor is in flow communication with a reservoir containing a portion of the compressor liquid.

6. The system of claim 1 which further comprises a variable-volume compressor liquid accumulator in flow communication with the discharge of the pump.

7. The system of claim 1 which further comprises a compressor liquid reservoir in flow communication with the inlet suction of the pump.

8. The system of claim 1 wherein the compressor liquid comprises one or more components selected from the group consisting of water, mineral oil, silicone oil, and fluorinated oil.

* * * * *